US012121153B2

(12) United States Patent
Shih et al.

(10) Patent No.: US 12,121,153 B2
(45) Date of Patent: Oct. 22, 2024

(54) HINGE AND ELECTRIC BED USING THE SAME

(71) Applicant: Chuan-Hang Shih, Lukang Township, Changhua County (TW)

(72) Inventors: Chuan-Hang Shih, Lukang Township, Changhua County (TW); Yu-Chi Yang, Lukang Township, Changhua County (TW)

(73) Assignee: Chuan-Hang Shih, Lukang Township (TW)

( * ) Notice: Subject to any disclaimer, the term of this patent is extended or adjusted under 35 U.S.C. 154(b) by 400 days.

(21) Appl. No.: 17/561,001

(22) Filed: Dec. 23, 2021

(65) Prior Publication Data

US 2023/0200549 A1 Jun. 29, 2023

(51) Int. Cl.
*A47C 20/04* (2006.01)

(52) U.S. Cl.
CPC ..... *A47C 20/041* (2013.01)

(58) Field of Classification Search
CPC ..... A47C 20/041; A47C 20/08
USPC ..... 5/616
See application file for complete search history.

(56) References Cited

U.S. PATENT DOCUMENTS 2,211,453 A * 8/1940 Buttikofer ..... A47C 20/041 5/616
3,012,253 A * 12/1961 Reichert ..... A61G 7/002 5/616
3,239,853 A * 3/1966 MacDonald ..... A61G 7/16 5/616
3,319,270 A * 5/1967 Greiner ..... A47C 17/68 297/29
3,447,170 A * 6/1969 Spitz ..... A47C 23/005 297/452.17
3,665,528 A * 5/1972 Kjellberg ..... A47C 20/041 5/618
3,821,821 A * 7/1974 Burst ..... A61G 7/002 5/616
3,958,283 A * 5/1976 Adams ..... A61G 7/002 5/616
4,346,489 A * 8/1982 McMullan ..... A47C 20/041 5/915
4,361,917 A * 12/1982 Wilson ..... A47C 20/08 5/616
4,381,571 A * 5/1983 Elliott ..... A61G 7/015 5/616
4,395,786 A * 8/1983 Casey ..... A61G 7/015 5/616
4,679,849 A * 7/1987 Torgny ..... A61G 5/006 5/619
4,685,159 A * 8/1987 Oetiker ..... A61G 7/02 5/616

(Continued)

*Primary Examiner* — Justin C Mikowski
*Assistant Examiner* — Luke Hall
(74) *Attorney, Agent, or Firm* — Muncy, Geissler, Olds & Lowe, P.C.

(57) ABSTRACT

A hinge includes identical first and second members each having a base portion with an end surface, a long arm with a pivot hole and a middle abutment surface and a short arm with a rear abutment surface both extending from the end surface, and a protrusion at a distal end of the long arm. Each protrusion has a front abutment. A pivot is inserted through the pivot holes to couple the first and second members in a way that the hinge is limited in a range of pivotal angle.

16 Claims, 10 Drawing Sheets

(56) References Cited

U.S. PATENT DOCUMENTS 4,685,160 A * 8/1987 Rizzardo ..... A61G 7/015 5/285
4,944,055 A * 7/1990 Shainfeld ..... A47C 20/08 5/619
5,381,570 A * 1/1995 Cheng ..... F16B 12/28 16/329
5,404,604 A * 4/1995 Has ..... A47C 20/041 5/617
5,542,151 A * 8/1996 Stranski ..... A47D 13/063 16/329
6,000,076 A * 12/1999 Webster ..... A61G 7/05 5/616
8,997,281 B2 * 4/2015 Daley ..... A61G 13/129 5/616
9,125,776 B1 * 9/2015 Shih ..... A61G 7/018
9,795,223 B1 * 10/2017 Shih ..... A61G 7/018
2002/0002743 A1 * 1/2002 Hartmann ..... A47C 20/08 5/613
2002/0152552 A1 * 10/2002 Dewert ..... A47C 27/20 5/722
2005/0000020 A1 * 1/2005 Schermel ..... A47C 20/04 5/507.1
2006/0021137 A1 * 2/2006 Waldman ..... A47D 13/063 5/99.1
2006/0022500 A1 * 2/2006 Roither ..... A47C 20/041 297/362
2013/0074257 A1 * 3/2013 Mendes ..... F16C 11/10 16/349
2013/0145553 A1 * 6/2013 Shih ..... A61G 7/015 5/624
2013/0147250 A1 * 6/2013 Kim ..... B60N 2/12 297/353
2014/0041121 A1 * 2/2014 Shan ..... A47C 21/006 5/618
2014/0325759 A1 * 11/2014 Bly ..... A61G 7/015 5/613
2016/0157623 A1 * 6/2016 Dewert ..... A47C 17/16 5/616
2017/0312155 A1 * 11/2017 Copetti ..... A47C 20/041
2018/0000253 A1 * 1/2018 Bellingroth ..... A47C 3/00
2019/0099008 A1 * 4/2019 Yin ..... A47C 23/34
2019/0117484 A1 * 4/2019 Shih ..... A61G 7/05
2019/0239653 A1 * 8/2019 Shan ..... A47C 20/041
2019/0307621 A1 * 10/2019 Kim ..... A61G 7/005
2019/0328593 A1 * 10/2019 Choi ..... A61G 7/018
2020/0054148 A1 * 2/2020 Zeng ..... A47C 19/005
2020/0172142 A1 * 6/2020 Young ..... B62B 7/142
2020/0237105 A1 * 7/2020 Eskridge, III ..... A47C 27/14
2020/0375368 A1 * 12/2020 Choi ..... A47C 20/04
2021/0378411 A1 * 12/2021 Xie ..... A47C 20/041
2022/0095802 A1 * 3/2022 Chen ..... A47C 20/041
2022/0333845 A1 * 10/2022 Xia ..... E05D 7/084

* cited by examiner

HINGE AND ELECTRIC BED USING THE SAME

BACKGROUND OF THE INVENTION

1. Field of the Invention

The present invention relates generally to an electric bed and more particularly, to a hinge adapted for being used in an electric bed and an electric bed equipped with the hinge.

2. Description of the Related Art

A conventional electric bed is generally equipped with a moveable frame, such as back supporting frame, which can be swung upwardly and downwardly. To adjust the angle of a user's head, a swingable head supporting frame is provided at a front end portion of the back supporting frame. The head supporting frame and the back supporting frame are connected with each other by a pivot and driven by two actuators. If only one actuator is provided for the purpose of reducing cost, linkage or long groove mechanism may be provided to enable the single actuator to drive the head supporting frame first and then the back supporting frame to move. However, the aforesaid mechanism requires many components with complicated assembling processes, thereby not facilitating cost reduction.

SUMMARY OF THE INVENTION

The present invention has been accomplished in view of the above-noted circumstances. It is an objective of the present invention to provide a hinge, which has a limited pivotal angle and can bear the weight of a human body, such that the hinge can be applied to an electric bed.

To attain the above objective, the present invention provides a hinge comprising first and second members and a pivot. The first member is defined with a first axis and comprises a first base portion, a first end surface at the first base portion, a first long arm extending outwardly from the first end surface and being parallel to the first axis, a first pivot hole penetrating through the first long arm and being perpendicular to the first axis, a first short arm extending outwardly from the first end surface and being parallel to the first axis, a first protrusion at a distal end of the first long arm, a first front abutment surface at the first protrusion, a first middle abutment surface at the first long arm, and a first rear abutment surface at the first short arm. The second member is defined with a second axis and comprises a second base portion, a second end surface at the second base portion, a second long arm extending outwardly from the second end surface and being parallel to the second axis, a second pivot hole penetrating through the second long arm and being perpendicular to the second axis, a second short arm extending outwardly from the second end surface and being parallel to the second axis, a second protrusion at a distal end of the second long arm, a second front abutment surface at the second protrusion, a second middle abutment surface at the second long arm, and a second rear abutment surface at the second short arm. The pivot is inserted through the first and second pivot holes to couple the first and second members in a way that the first member is swingable relative to the second member between a first state and a second state.

In the first state, the first middle abutment surface is abutted against the second rear abutment surface, the first rear abutment surface is abutted against the second middle abutment surface, the first front abutment surface is not abutted against the second end surface, and the first end surface is not abutted against the second front abutment surface. In the second state, the first middle abutment surface is not abutted against the second rear abutment surface, the first rear abutment surface is not abutted against the second middle abutment surface, the first front abutment surface is abutted against the second end surface, and the first end surface is abutted against the second front abutment surface. With the aforesaid structural, the hinge is limited to turn in a predetermined range of pivotal angle and can bear the weight of a human. As such, the hinge can be used in an electric bed.

Another objective of the present invention is to provide an electric bed using the forgoing hinge to enable an actuator to sequentially drive two moveable frames and to maintain the two moveable frames at a predetermined relative angle.

To attain the above objective, the present invention provides an electric bed comprises a base mount, a back supporting frame, a head supporting frame, at least one hinge mentioned above, and an actuator. The back supporting frame is adapted for supporting a user's back, and provided with a rear end portion pivotally connected with the base mount. The head supporting frame is adapted for supporting a user's head and located at a front end portion of the back supporting frame. The first member of the hinge is connected with the back supporting frame, and the second member of the hinge is connected with the head supporting frame. The actuator has two ends disposed with the base mount and the head supporting frame, respectively. As a result, the electric bed can use only one actuator to drive the head supporting frame and the back supporting frame to move sequentially, and to enable the head supporting frame and the back supporting frame to be maintained with a predetermined relative angle therebetween.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
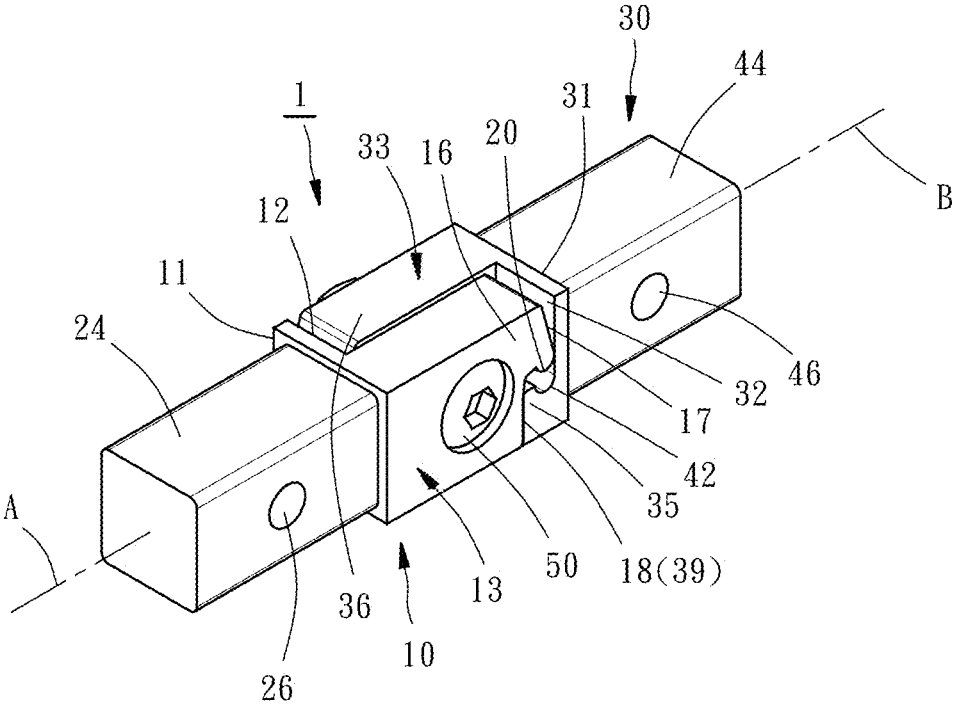
FIGS. 1 and 2 are perspective views of a hinge according to an embodiment of the present invention.
Figure 2:
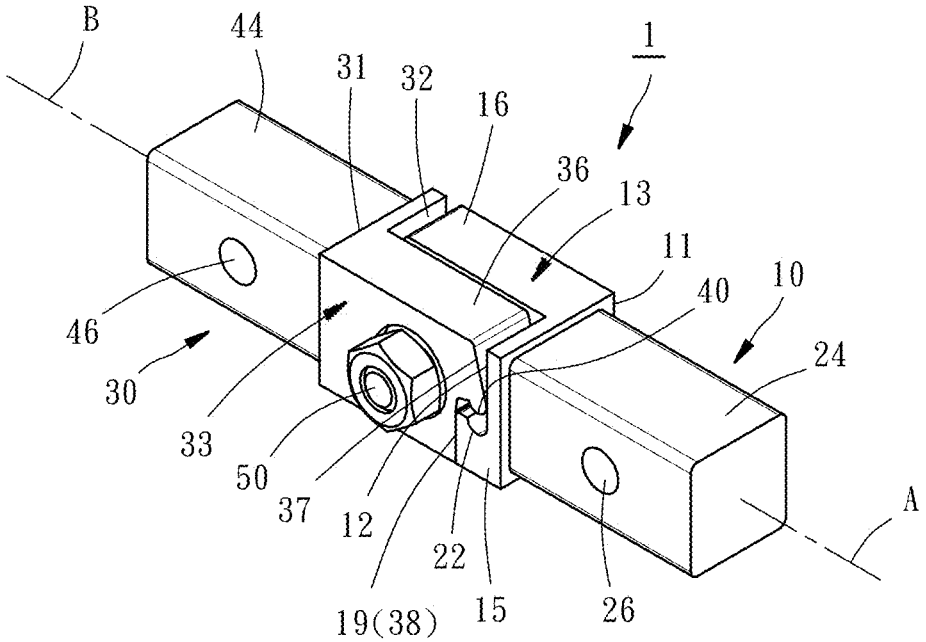

The structure and technical features of the present invention will be detailedly described hereunder by embodiments and accompany drawings. As shown in FIGS. 1-2, a hinge 1 provided in accordance with an embodiment of the present invention comprises a first member 10, a second member 30, and a pivot 50.

Figure 3:
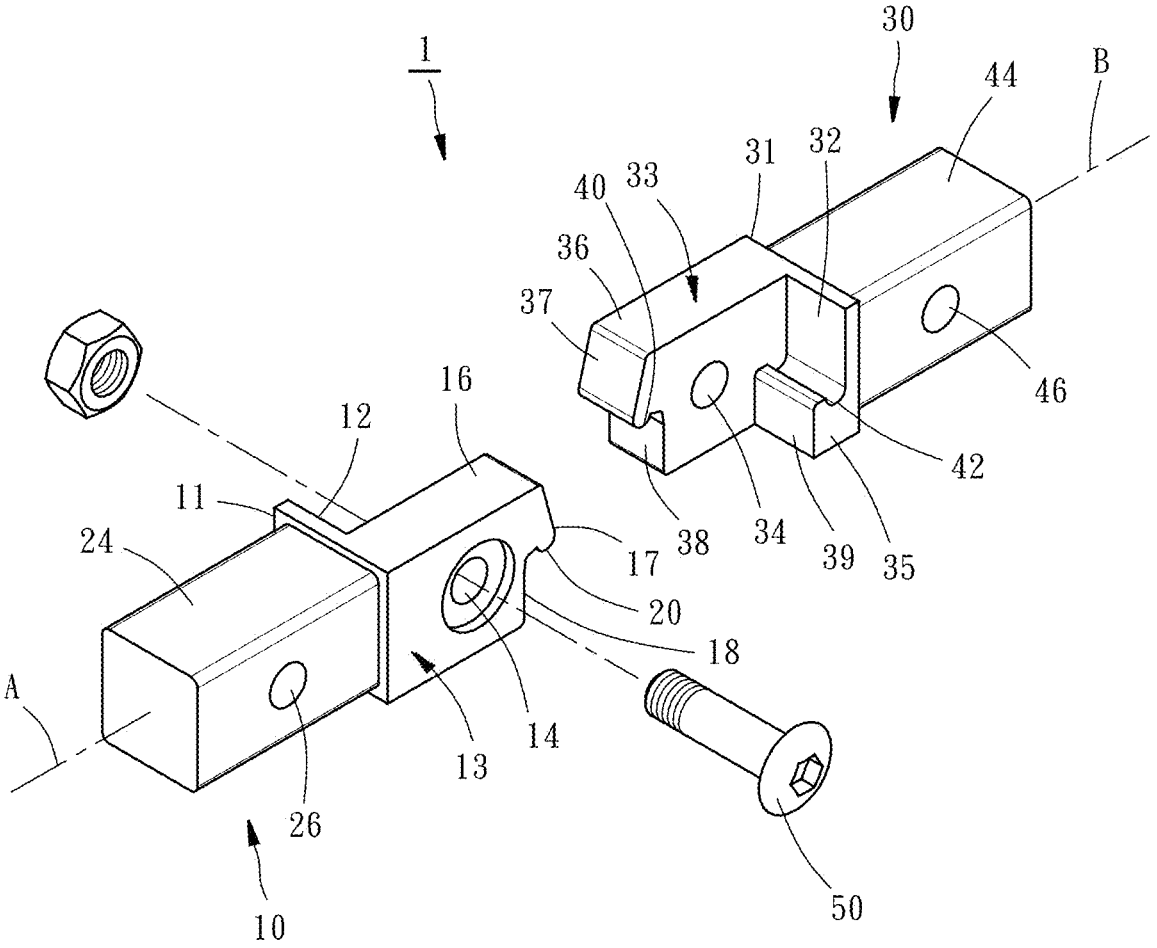
FIGS. 3 and 4 are exploded views of the hinge of the embodiment of the present invention.
Figure 4:
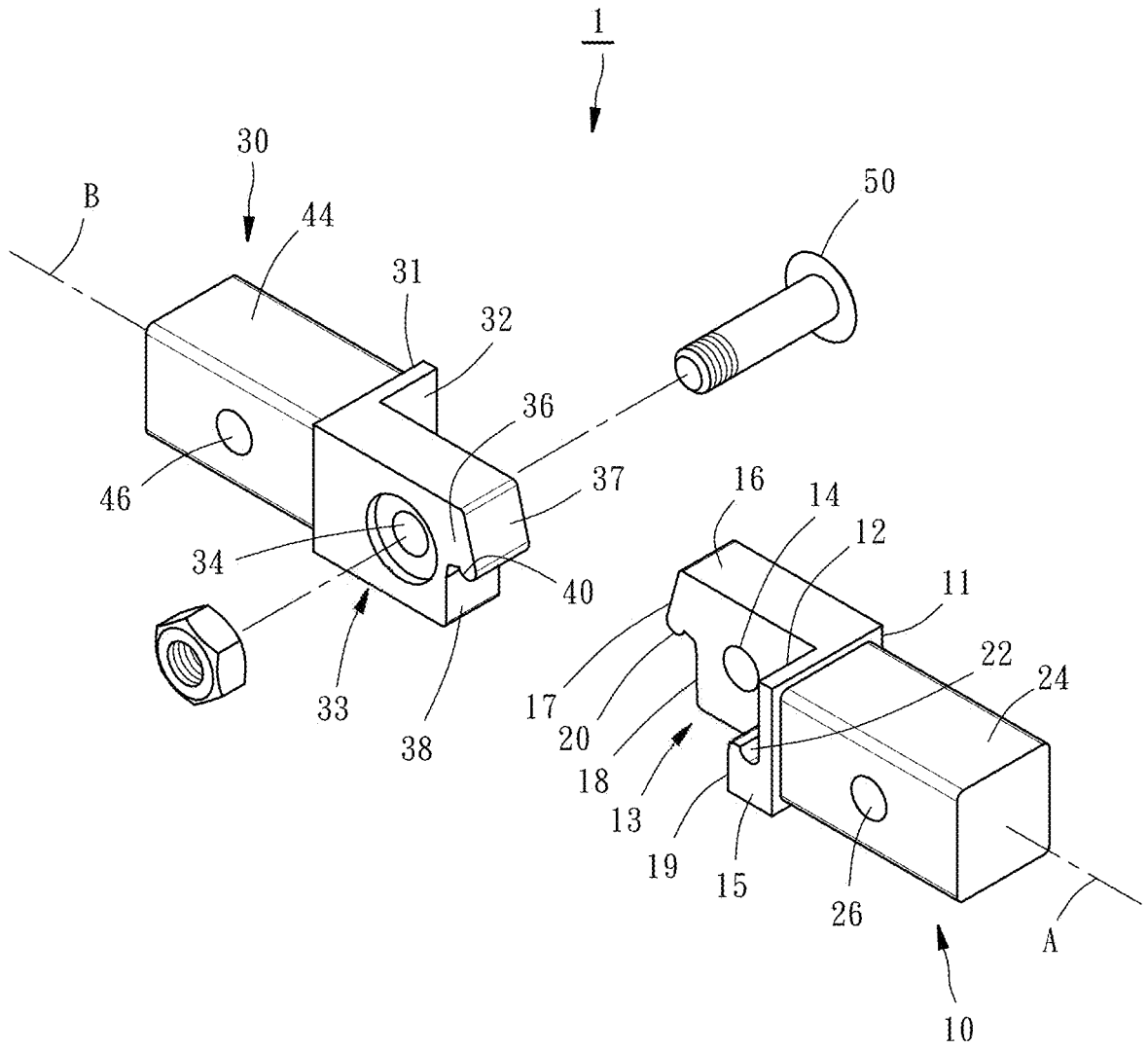

As shown in FIGS. 3 and 4, the first member 10 comprises a first base portion 11, a first end surface 12 at the first base portion 11, a plate-shaped first long arm 13 extending outwardly from the first end surface 12 and being parallel to a first axis A, a first pivot hole 14 penetrating through the first long arm 13 and being perpendicular to the first axis A, a first short arm 15 extending outwardly from the first end surface 12 and being parallel to the first axis A, a first protrusion 16 at a distal end of the first long arm 13, a first front abutment surface 17 at an end of the first protrusion 16, a first middle abutment surface 18 at an end of the first long arm 13, and a first rear abutment surface 19 at an end of the first short arm 15. In this embodiment, the first middle abutment surface 18, the first rear abutment surface 19 and the first end surface 12 are all perpendicular to the first axis A. An included angle of about 15° is defined between the first front abutment surface 17 and the first middle abutment surface 18. The first member further comprises a first front step surface 20 located between the first front abutment surface 17 and the first middle abutment surface 18, and a first rear step surface 22 located between the first rear abutment surface 19 and the first end surface 12. The first front and rear step surfaces 20 and 22 are both curved surfaces of S shape; however, they may be flat surfaces or other shapes in other embodiments. The first base portion 11 includes a first insertion rod 24 having a sectional area smaller than that of the first end surface 12. The first insertion rod 24 extends in a direction parallel to the first axis A and has a first through hole 26 perpendicular to the first axis A.

As shown in FIGS. 3-4, the second member 30 and the first member 10 have exactly the same shape; however, they are arranged in reverse orientations. Specifically speaking, the second member 30 comprises a second base portion 31, a second end surface 32 at the second base portion 31, a plate-shaped second long arm 33 extending outwardly from the second end surface 32 and being parallel to a second axis B, a second pivot hole 34 penetrating through the second long arm 33 and being perpendicular to the second axis B, a second short arm 35 extending outwardly from the second end surface 32 and being parallel to the second axis B, a second protrusion 36 at a distal end of the second long arm 33, a second front abutment surface 37 at an end of the second protrusion 36, a second middle abutment surface 38 at an end of the second long arm 33, and a second rear abutment surface 39 at an end of the second short arm 35. In this embodiment, the second middle abutment surface 38, the second rear abutment surface 39 and the second end surface 32 are all perpendicular to the second axis B. An included angle of about 15° is defined between the second front abutment surface 37 and the second middle abutment surface 38. The second member 30 further comprises a second front step surface 40 located between the second front abutment surface 37 and the second middle abutment surface 38, and a second rear step surface 42 located between the second rear abutment surface 39 and the second end surface 32. The second front and rear step surfaces 40 and 42 are both curved surfaces of S shape: however, they may be flat surfaces or other shapes in other embodiments. The second base portion 31 includes a second insertion rod 44 having a sectional area smaller than that of the second end surface 32. The second insertion rod 44 extends in a direction parallel to the second axis B and has a second through hole 46 perpendicular to the second axis B. However, in another embodiment, the extending direction of the first insertion rod 24 may be nonparallel to the first axis A, the extending direction of the second insertion rod 44 may be nonparallel to the second axis B, and the shapes of the first and second members 10 and 30 may be different from each other.

The pivot 50 is inserted through the first pivot hole 14 and the second pivot hole 34 to couple the first and second members together.

Figure 5:
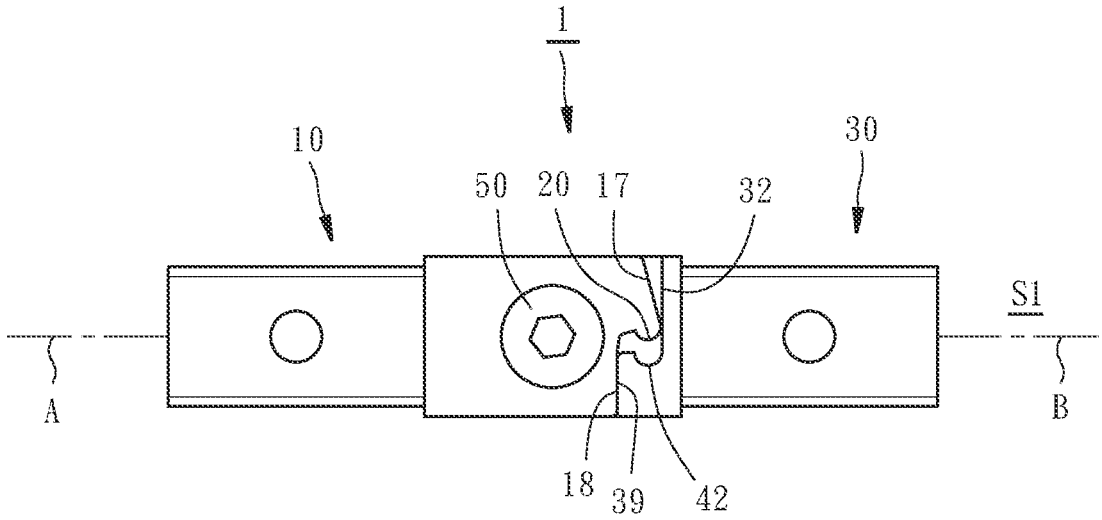
FIGS. 5 and 6 are schematic views showing the hinge of the embodiment of the present invention in various states of use.
Figure 6:
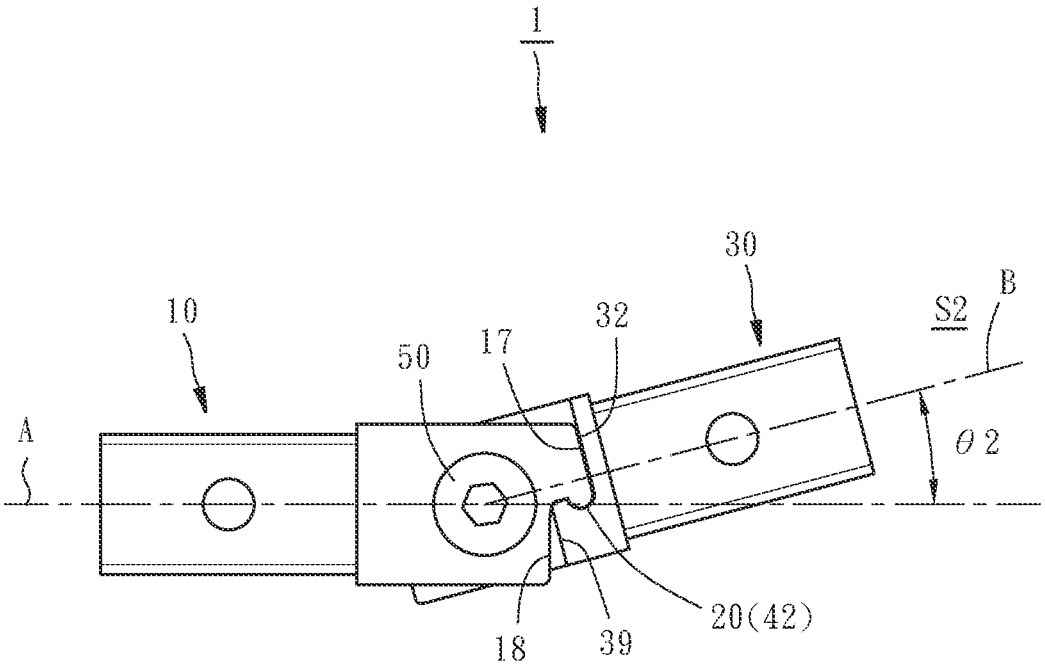

With the above-described structural features, the first member 10 is swingable relative to the second member 30 from a first state S1 to a second state S2. As shown in FIG. 5, in the first state S1, the first middle abutment surface 18 is abutted against the second rear abutment surface 39, the first rear abutment surface 19 is abutted against the second middle abutment surface 38, the first front abutment surface 17 is not abutted against, i.e., is departed from, the second end surface 32, the first end surface 12 is not abutted against, i.e., is departed from, the second front abutment surface 37, the first front step surface 20 is not abutted against the second rear step surface 42, and the first rear step surface 22 is not abutted against the second front step surface 42. At this first state S1, when being viewed along the axis of the first pivot hole 14, the first axis A is parallel to the second axis B. That is, the first axis A is defined with the second axis B a first included angle θ1 of 0°. As shown in FIG. 6, in the second state S2, the first middle abutment surface 18 is not abutted against the second rear abutment surface 39, the first rear abutment surface 19 is not abutted against the second middle abutment surface 38, the first front abutment surface 17 is abutted against the second end surface 32, the first end surface 12 is abutted against the second front abutment surface 37, the first front step surface 20 is abutted against the second rear step surface 42, and the first rear step surface 22 is abutted against the second front step surface 42. At this second state S2, when being viewed along the axis of the first pivot hole 14, the first axis A is defined with the second axis B a second included angle θ2 of 15°.

With the above-mentioned structural design, the hinge 1 provided by the present invention can be operated to change the relationship between the first and second members 10 and 30 from a parallel manner (i.e., the first state S1) to an inclined manner of 15° (i.e., the second state S2). Further, because the hinge 1 provides a thick and solid structure with large abutment areas, and the S-shaped first front step surface 20 is anchored with the S-shaped second rear step surface 42 and the S-shaped first rear step surface 22 is anchored with the S-shaped second front step surface 40, the hinge 1 can bear exceeding stress without any problem even if the weight of a user is much heavier than a normal level. As such, the hinge 1 of the present invention can be used in the filed of electric bed to meet the requirements of the electric beds, thereby achieving the objective of the present invention.

Figure 7:
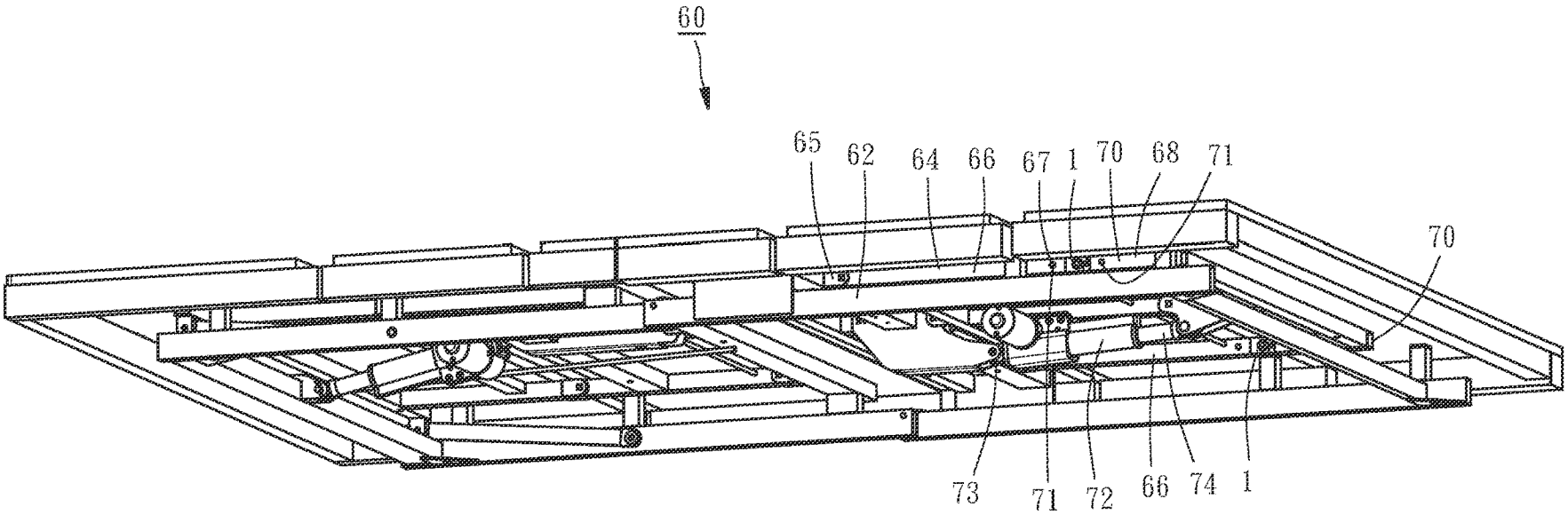
FIG. 7 is a perspective view of an aforementioned-hinge-equipped electric bed in accordance with a first embodiment of the present invention.

FIG. 7 is a perspective view showing an electric bed 60 provided in accordance with a first embodiment of present invention and equipped with the above-mentioned hinge 1. Specifically, the electric bed 60 comprises a base mount 62, a back supporting frame 64, a head supporting frame 68, two hinges 1, and an actuator 72.

The base mount 62 is adapted for being placed on a ground or a surface of the bed frame for supporting other components of the electric bed. The back supporting frame 64 is adapted for supporting a user's back and provided with a rear end portion 65 pivotally connected with the base mount 62. The back supporting frame 64 comprises two first longitudinal tubes 66. The head supporting frame 68 is adapted for supporting a user's head and located at a front end portion 67 of the back supporting frame 67. The head supporting frame 68 comprises two second longitudinal tubes 70 in alignment with the two first longitudinal tubes 66, respectively. The first member 10 of each hinge 1 is connected with the back supporting frame 64, and the second member 30 of each hinge 1 is connected with the head supporting frame 68. Specifically speaking, a respective first member 10 is connected with an associated first longitudinal tube 66 by inserting the first insertion rod 24 thereof into the associated first longitudinal tube 66, and then inserting a pin 71 through the associated first longitudinal tube 66 and the first through hole 26. Similarly, a respective second member 30 is connected with an associated second longitudinal tube 70 by inserting the second insertion rod 44 thereof into the associated second longitudinal tube 70, and then inserting another pin 71 through the associated second longitudinal tube 70 and the second through hole 46. As a result, the head supporting frame 68 and the back supporting frame 64 are pivotally connected with each other and are swingable relative to each other.

Figure 8:
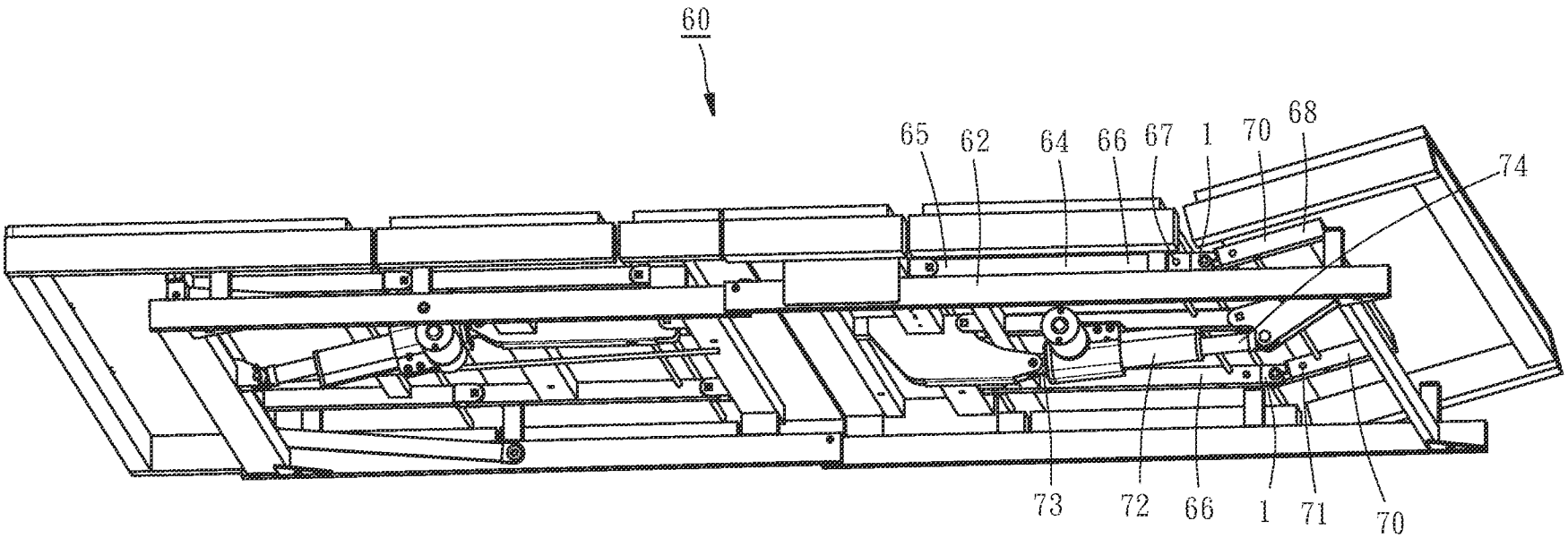
FIGS. 8 and 9 are schematically perspective views showing the electric bed of the first embodiment of the present invention in various states of use.
Figure 9:
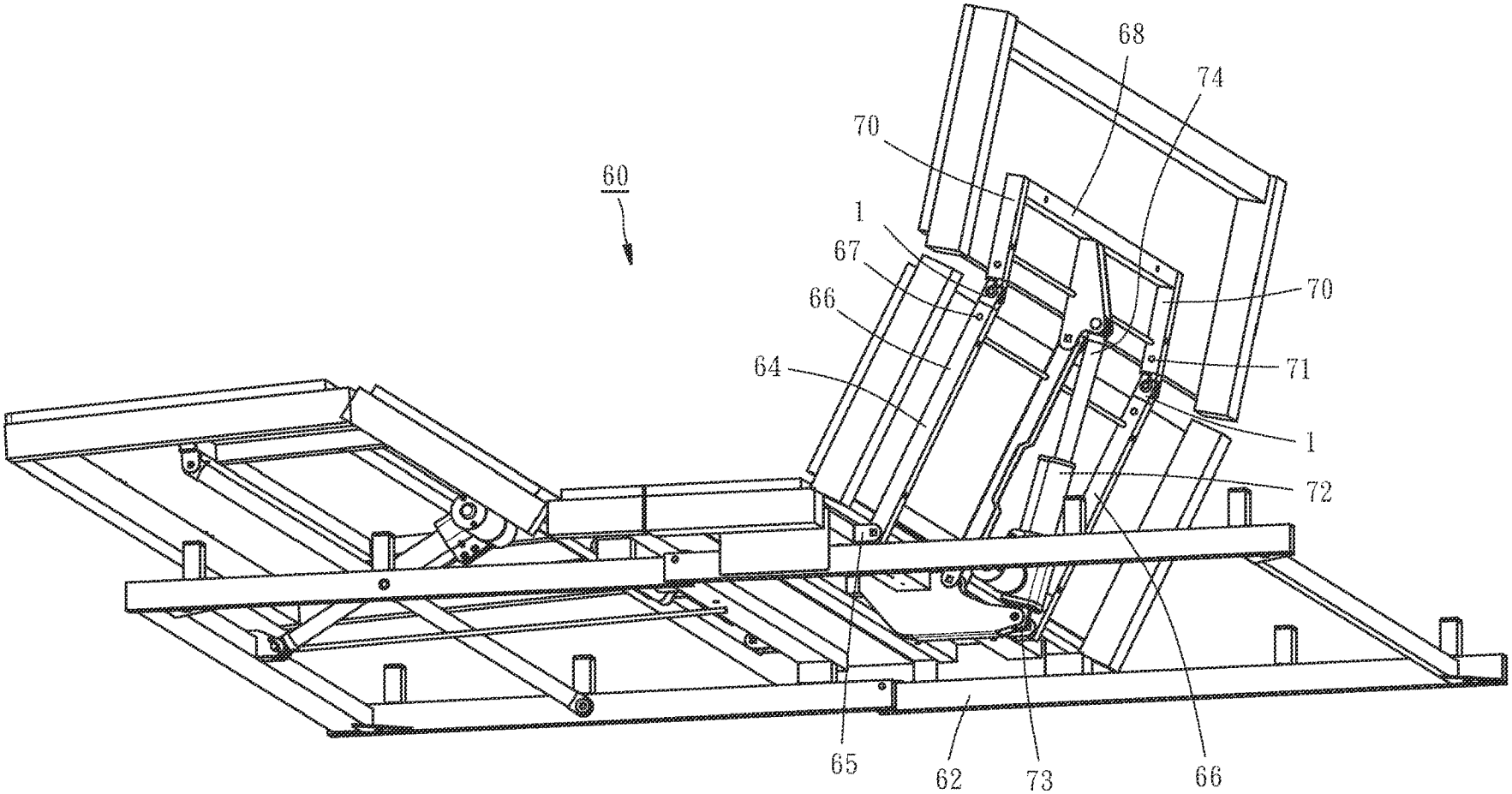

The actuator 72 has a rear end 73 mounted to the base mount 62, and a front end 74 mounted to the head supporting frame 68. When the actuator 72 is operated to shorten it overall length, the head supporting frame 68 is just abutted with the base mount 62 and the head supporting frame 68 is flush with the back supporting frame 64, i.e., a top surface of the head supporting frame 68 and a top surface of the back supporting frame 64 are coplanarly parallel to each other. At this condition, the hinges 1 are stayed at the first state S1 as shown in FIG. 7. When the actuator 72 is operated to extend its overall length, the head supporting frame 68 is upwardly swung relative to the base mount 62 to an extent that the head supporting frame 68 is defined with the back supporting frame 64 an included angle of 15°. At this condition, the hinges 1 are stayed at the second state S2 as shown in FIG. 8. When the actuator 72 is further operated to continuously extend its length, the head supporting frame 68 and the back supporting frame 64 will be concurrently and upwardly swung relative to the base mount 62, as shown in FIG. 9. As this condition, the hinges 1 are maintained in the second state S2.

As a result, only one actuator 72 needs to be installed in the electric bed 60 of the present application to achieve sequential motions of upwardly lifting the head supporting frame 68 first and then upwardly lifting the back supporting frame 64, without the needs of providing extra components, such as linkages or long grooves. In this way, the present application provides an electric bed 60 having a simple structure and being assembled conveniently and quickly, thereby reducing manufacturing cost and facilitating assembly by a user himself/herself.

Figure 10:
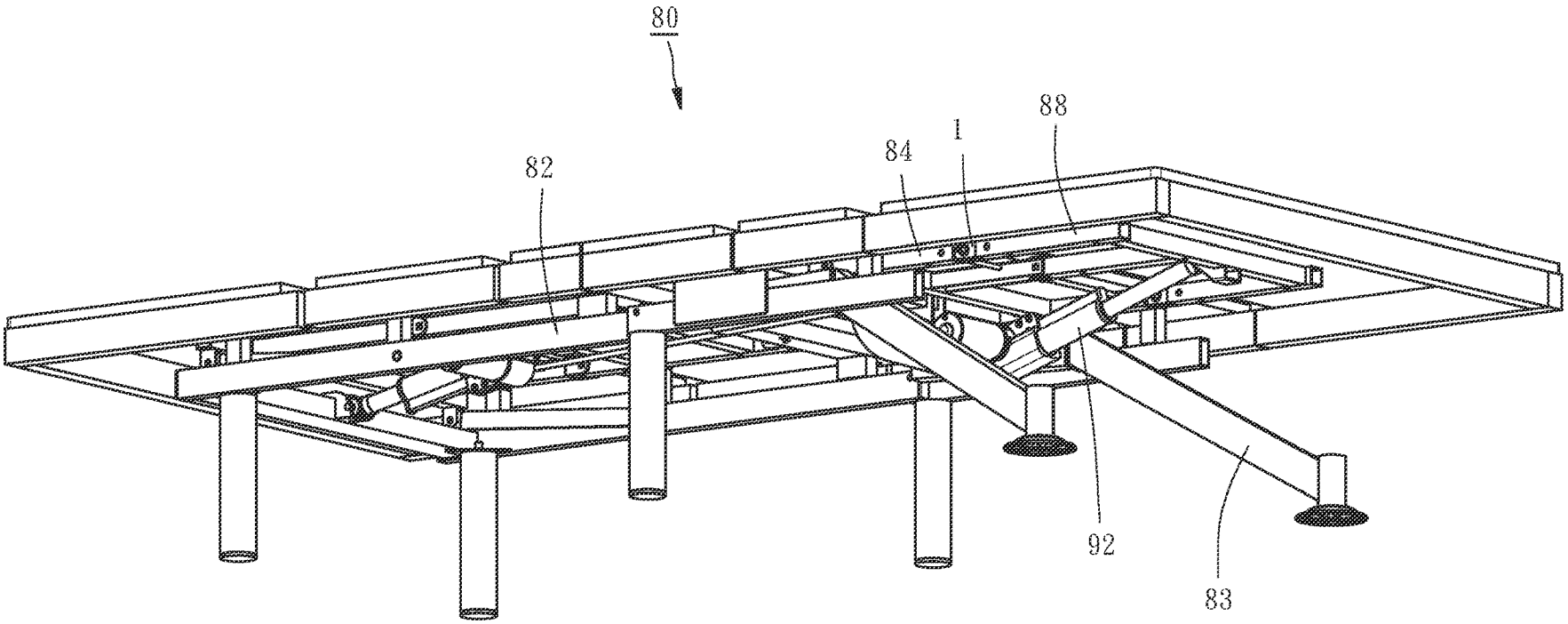
FIG. 10 is a perspective view of an aforesaid-hinge-equipped electric bed in accordance with a second embodiment of the present invention.
Figure 11:
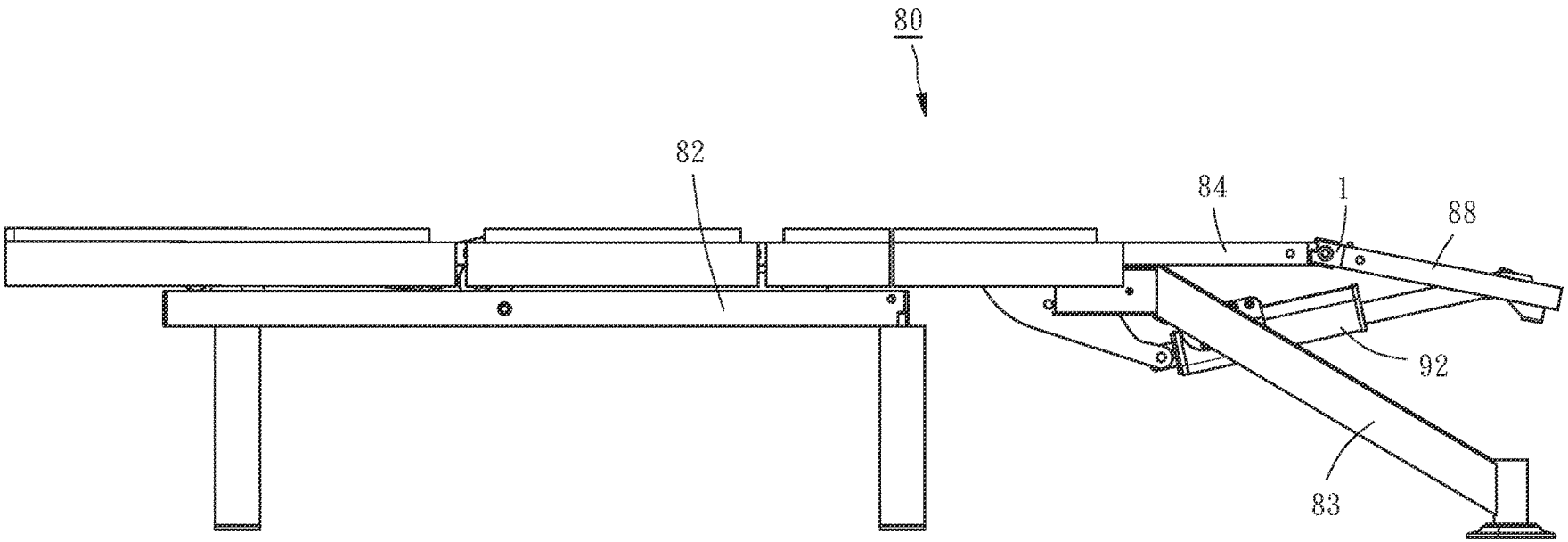
FIGS. 11 and 12 are schematically perspective views showing the electric bed of the second embodiment of the present invention in various states of use.
Figure 12:
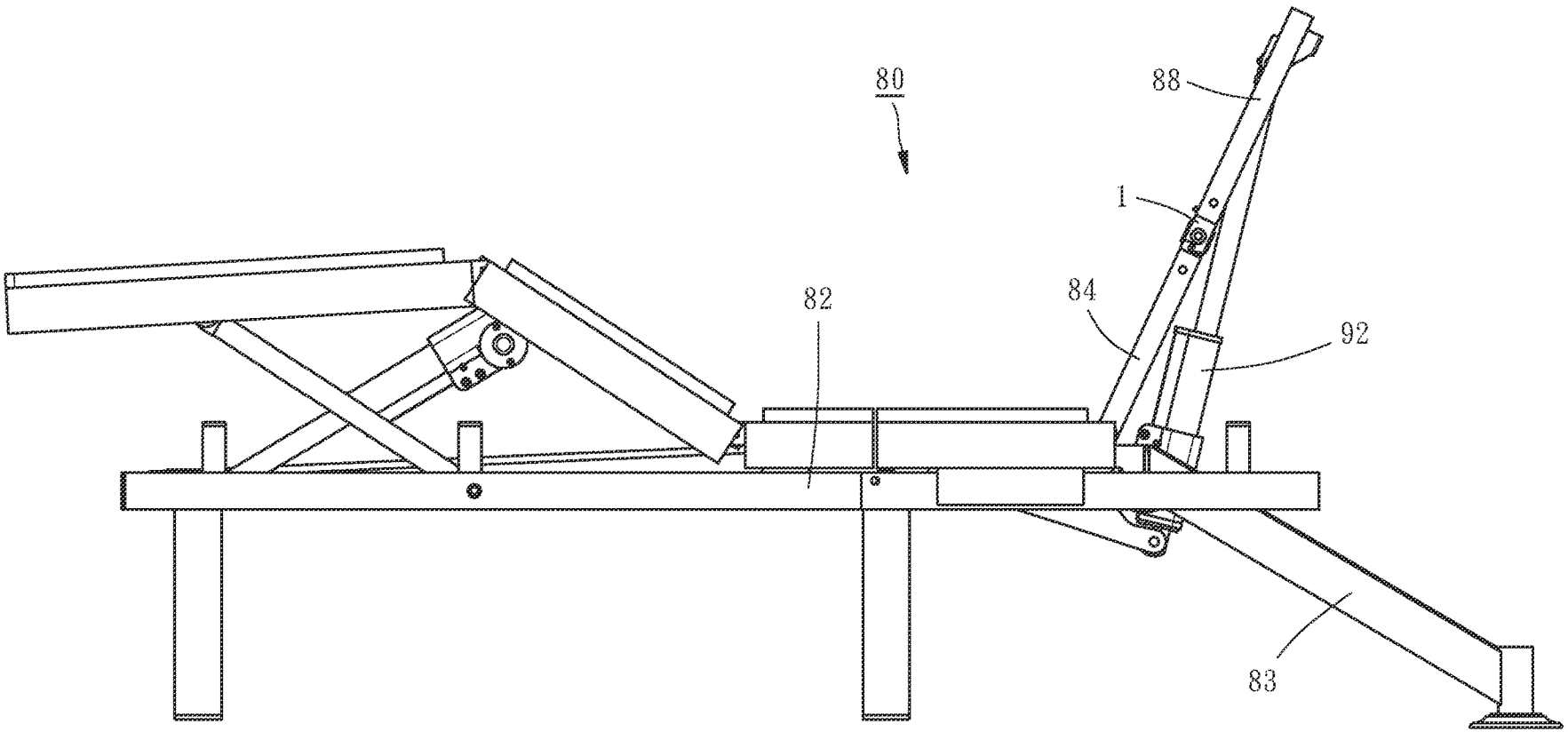

The hinge 1 of the present invention may be arranged in an electric bed in may ways. For example, FIG. 10 is a perspective view showing an electric bed 80 provided in accordance with a second embodiment of present invention and equipped with the above-mentioned hinge 1. Similar to the electric bed 60 of the present invention, the electric bed 80 comprises a base mount 82, a back supporting frame 84, a head supporting frame 88, two hinges 1, and an actuator 92 with the difference lying in that the base mount 82 includes six support legs 83, and the installation orientations of the hinges 1 are arranged upside down. As such, when the hinges 1 are stayed at the first state S2, the head supporting frame 88 is downwardly swung relative to the back supporting frame 84 to an extent that the head supporting frame 88 is defined with the back supporting frame 84 an included angle of 15°, as shown in FIG. 11, facilitating sleep on a user's stomach. When the actuator 92 is operated to extend its length, the hinges 1 will be returned to the first state S1, such that the head and back supporting frames 88 and 84 are parallel to each other and the top surfaces thereof form a coplanar surface, as shown in FIG. 10. When the actuator 92 is further operated to continuously extend its length, the head supporting frame 88 and the back supporting frame 84 will be concurrently and upwardly swung relative to the base mount 82, as shown in FIG. 12. As this condition, the hinges 1 are maintained in the first state S1. In this way, the electric bed 80 can also achieve the advantageous effects of simple structure and convenient assembly.

Based on the technical features of the present invention, various modifications to the hinge 1 may be made. For example, the included angle between the first front abutment surface 17 and the first middle abutment surface 18 may be designed to be greater than 5° and smaller than 30°, or the included angle between the second front abutment surface 37 and the second middle abutment surface 38 may be designed to be greater than 5° and smaller than 30°, resulting in change of the included angle between the first and second axes A and B at the first state S1 or the second state S2. For example, when the hinge 1 is stayed at the first state S1 or the second state S2, a first or second included angle θ1 or θ2 is defined between the first axis A and the second axis B, respectively, and a difference between the first and second included angles θ1 and θ2 may be designed as having an absolute value greater than 5° and smaller than 30°. Furthermore, the first middle abutment surface 18, the first rear abutment surface 19, or the first end surface 12 may be configured as being nonparallel to the first axis A, and the second middle abutment surface 38, the second rear abutment surface 39, or the second end surface 32 may be configured as being nonparallel to the second axis B. Moreover, the first front and rear step surfaces 20 and 22 and the second front and rear step surfaces 40 and 42 may be omitted. One or more hinges 1 may be installed in other places of an electric bed, such as the place between the base mount and a thigh supporting frame. Such variations are not to be regarded as a departure from the spirit and scope of the invention, and all such modifications as would be obvious to one skilled in the art are intended to be included within the scope of the following claims.

What is claimed is:

1. A hinge, comprising:

a first member configured to define a first axis and include a first base portion, a first end surface at the first base portion, a first long arm extended outwardly from the first end surface, provided at a distal end thereof with a first protrusion and parallel to the first axis, a first pivot hole penetrated through the first long arm and perpendicular to the first axis, a first short arm extended outwardly from the first end surface and parallel to the first axis, a first front abutment surface at the first protrusion, a first middle abutment surface at the first long arm, and a first rear abutment surface at the first short arm;

a second member configured to define a second axis and include a second base portion, a second end surface at the second base portion, a second long arm extended outwardly from the second end surface, provided at a distal end thereof with a second protrusion and parallel to the second axis, a second pivot hole penetrated through the second long arm and perpendicular to the second axis, a second short arm extended outwardly from the second end surface and parallel to the second axis, a second front abutment surface at the second protrusion, a second middle abutment surface at the second long arm, and a second rear abutment surface at the second short arm; and a pivot inserted through the first and second pivot holes to couple the first and second members, such that the first member is swingable relative to the second member between a first state and a second state;

wherein in the first state, the first middle abutment surface is abutted against the second rear abutment surface, the first rear abutment surface is abutted against the second middle abutment surface, the first front abutment surface is not abutted against the second end surface, and the first end surface is not abutted against the second front abutment surface;

wherein in the second state, the first middle abutment surface is not abutted against the second rear abutment surface, the first rear abutment surface is not abutted against the second middle abutment surface, the first front abutment surface is abutted against the second end surface, and the first end surface is abutted against the second front abutment surface.

2. The hinge as claimed in claim 1, wherein the first member has a shape identical to a shape of the second member.

3. The hinge as claimed in claim 1, wherein the first front abutment surface is defined with the first middle abutment surface with an included angle greater than 5° and smaller than 30°.

4. The hinge as claimed in claim 3, wherein the first axis is normal to the first middle abutment surface, the first rear abutment surface and the first end surface.

5. The hinge as claimed in claim 3, wherein in the first state, a first angle is defined between the first axis and the second axis; in the second state, a second angle is defined between the first axis and the second axis; a difference between the first and second angles has an absolute value greater than 5° and smaller than 30°.

6. The hinge as claimed in claim 3, wherein the first member comprises a first front step surface located between the first front abutment surface and the first middle abutment surface, and a first rear step surface located between the first rear abutment surface and the first end surface; the second member comprises a second front step surface located between the second front abutment surface and the second middle abutment surface, and a second rear step surface located between the second rear abutment surface and the second end surface.

7. The hinge as claimed in claim 6, wherein the first front step surface, the first rear step surface, the second front step surface, and the second rear step surface are curved surfaces; in the second state, the first front step surface is abutted against the second rear step surface, and the first rear step surface is abutted against the second front step surface.

8. An electric bed, comprising:

a base mount;

a back supporting frame having a rear end portion pivotally connected with the base mount for supporting a user's back;

a head supporting frame located at a front end portion of the back supporting frame for supporting a user's head;

at least one hinge as claimed in claim 1, the first member of the at least one hinge being connected with the back supporting frame, and the second member of the at least one hinge being connected with the head supporting frame; and an actuator having two ends disposed with the base mount and the head supporting frame, respectively.

9. The electric bed as claimed in claim 8, wherein in the first state, a top surface of the head supporting frame is parallel to a top surface of the back supporting frame; in the second state, the top surface of the head supporting frame is defined with the top surface of the back supporting frame with an included angle greater than 5° and smaller than 30°.

10. The electric bed as claimed in claim 8, wherein the head supporting frame is configured to be driven by the actuator to swing relative to the back supporting frame upwardly or downwardly.

11. The electric bed as claimed in claim 8, wherein the first member has a shape identical to a shape of the second member.

12. The electric bed as claimed in claim 8, wherein the first front abutment surface is defined with the first middle abutment surface with an included angle greater than 5° and smaller than 30°.

13. The electric bed as claimed in claim 12, wherein the first axis is normal to the first middle abutment surface, the first rear abutment surface and the first end surface.

14. The electric bed as claimed in claim 12, wherein in the first state, a first angle is defined between the first axis and the second axis; in the second state, a second angle is defined between the first axis and the second axis; a difference between the first and second angles has an absolute value greater than 5° and smaller than 30°.

15. The electric bed as claimed in claim 12, wherein the first member comprises a first step surface located between the first front abutment surface and the first middle abutment surface, and a first rear step surface located between the first rear abutment surface and the first end surface; the second member comprises a second step surface located between the second front abutment surface and the second middle abutment surface, and a second rear step surface located between the second rear abutment surface and the second end surface.

16. The electric bed as claimed in claim 15, wherein the first front step surface, the first rear step surface, the second front step surface, and second rear step surface are curved surfaces; in the second state, the first front step surface is abutted against the second rear step surface, and the first rear step surface is abutted against the second front step surface.

* * * * *